US007386243B2

(12) United States Patent
Kinouchi et al.

(10) Patent No.: US 7,386,243 B2
(45) Date of Patent: Jun. 10, 2008

(54) HEATING APPARATUS AND INDUCTION HEATING CONTROL METHOD

(75) Inventors: Satoshi Kinouchi, Tokyo (JP); Osamu Takagi, Chofu (JP); Yoshinori Tsueda, Fuji (JP); Toshihiro Sone, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 276 days.

(21) Appl. No.: 11/368,598

(22) Filed: Mar. 7, 2006

(65) Prior Publication Data

US 2007/0212091 A1 Sep. 13, 2007

(51) Int. Cl.
*G03G 15/20* (2006.01)

(52) U.S. Cl. ..... 399/69; 399/122; 399/328; 399/330

(58) Field of Classification Search ..... 399/38, 399/67, 69, 122, 320, 328, 330; 219/619
See application file for complete search history.

(56) References Cited

U.S. PATENT DOCUMENTS

| | | | |
|---|---|---|---|
| 6,078,781 A | 6/2000 | Takagi et al. | |
| 6,097,926 A | 8/2000 | Takagi et al. | |
| 6,725,000 B2 | 4/2004 | Takagi et al. | |
| 6,861,630 B2 | 3/2005 | Kinouchi et al. | |
| 6,868,249 B2 | 3/2005 | Kinouchi et al. | |
| 6,868,250 B2 | 3/2005 | Takagi et al. | |
| 6,872,925 B2 * | 3/2005 | Asakura et al. | 219/619 |
| 6,889,018 B2 | 5/2005 | Kinouchi et al. | |
| 6,936,800 B2 | 8/2005 | Kinouchi et al. | |
| 2004/0188421 A1 | 9/2004 | Takagi et al. | |
| 2004/0265021 A1 | 12/2004 | Kinouchi et al. | |
| 2005/0031365 A1 | 2/2005 | Takagi et al. | |
| 2005/0063726 A1 | 3/2005 | Kinouchi et al. | |
| 2005/0175369 A1 | 8/2005 | Kinouchi et al. | |
| 2005/0263521 A1 | 12/2005 | Kinouchi et al. | |

FOREIGN PATENT DOCUMENTS

| | | |
|---|---|---|
| JP | 2004-151470 A | 5/2004 |
| JP | 2004-157503 A | 6/2004 |

OTHER PUBLICATIONS

U.S. Appl. No. 10/945,395, filed Sep. 21, 2004, Kinouchi et al.

* cited by examiner

*Primary Examiner*—Hoan Tran
(74) *Attorney, Agent, or Firm*—Foley & Lardner LLP

(57) ABSTRACT

In an aspect of this invention, a fixing device includes a heating member including a first area and a second area formed of conductive members (e.g., aluminum and iron) having different magnetic permeability ratios, and an induction heating unit which generates a magnetic field from a coil to induction-heat this heating member, and the fixing device changes a frequency of a high-frequency current to be supplied to the coil to thereby control a heating area of the heating member.

20 Claims, 9 Drawing Sheets

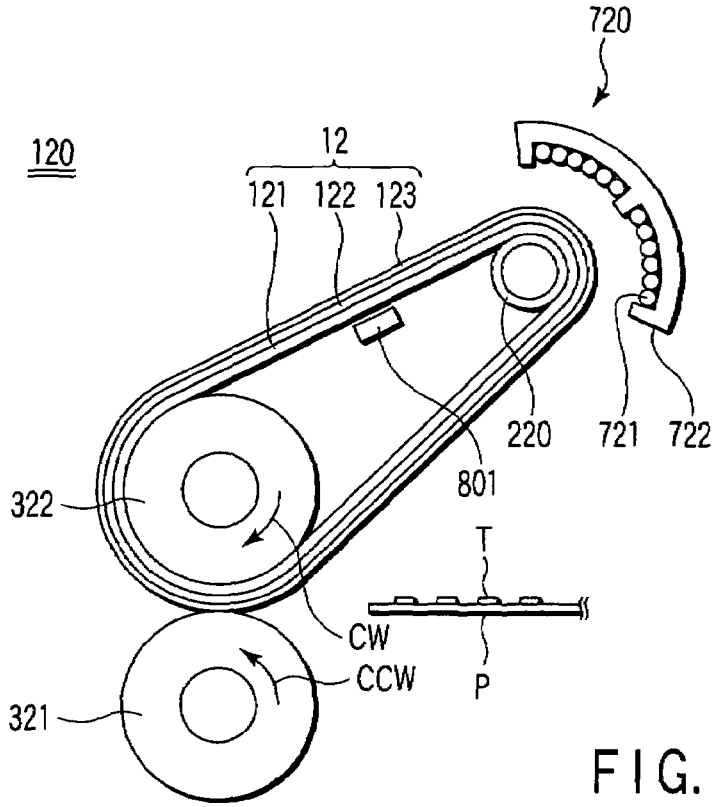
FIG. 7
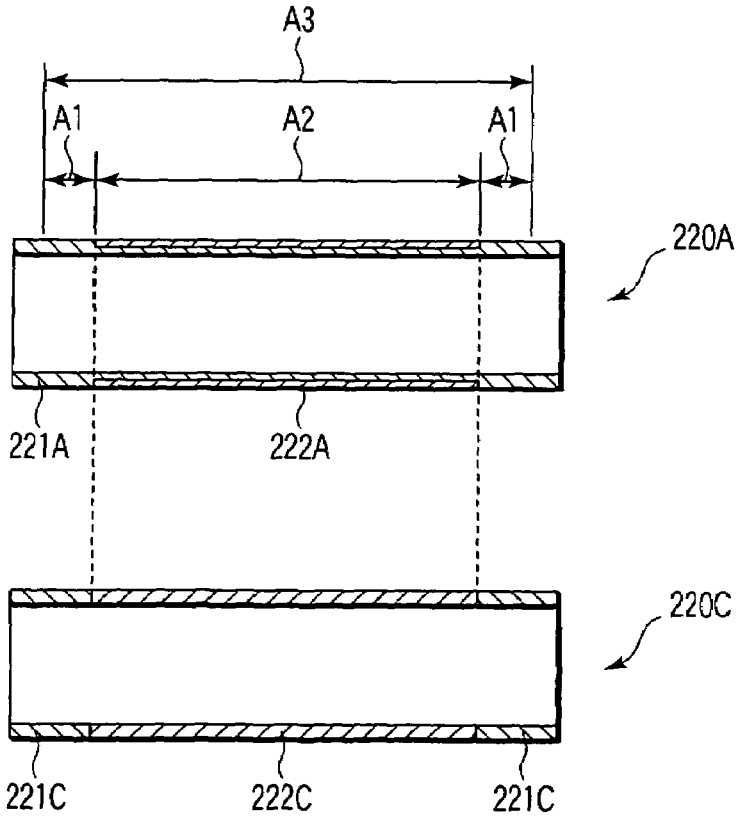
FIG. 8A
FIG. 8B

HEATING APPARATUS AND INDUCTION HEATING CONTROL METHOD

FIELD OF THE INVENTION

The present invention relates to a fixing device which is mounted on an image forming device, a copying machine, a printer or the like to form an image on a transfer material by use of an electrophotographic process and which fixes, to the transfer material, a developer on the transfer material.

BACKGROUND OF THE INVENTION

In a copying machine or a printer using an electronic process, it is known that a toner image formed on a photosensitive drum is transferred to a transfer member, and thereafter the melted toner image by a fixing device including a heating roller and a pressurizing roller is fixed to the transfer member.

Furthermore, an induction heating system is known in which, in the above case, the surface of the heating roller is heated using a plurality of coils. In a case where the plurality of coils are utilized, cost might increase as compared with a case where one coil is utilized. In this case, circuits to drive the plurality of coils must be prepared in accordance with the number of the coils, which leads to the cost increase, and in addition, there rises a problem that the whole device is enlarged.

Moreover, as disclosed in Jpn. Pat. Appln. KOKAI Publication No. 2004-151470, in a case where a temperature of a conductive member for use in the heating roller exceeds the Curie point, a skin effect deepens, and therefore the conductive member does not generate any heat. This is utilized, and heating of the heating roller is stopped at a time when it is detected that a temperature of the heating roller rises to an abnormal temperature. In this known technology, in a case where the temperature of the whole heating roller exceeds the Curie point, there is not any problem even when power supply is stopped with respect to a coil which supplies a magnetic field to the conductive member of the heating roller. However, in a case where a small-sized sheet continues to be passed, the temperature reaches the Curie point on the only surface of the heating roller in a portion through which any sheet does not pass, and the conductive member of this portion has an increased depth of penetration. Therefore, any heat is not generated from the only heating roller of the portion through which any sheet does not pass. In this case, since the driving circuit for supplying the power to the coil is not matched with the heating roller, it becomes difficult to heat an only area that passes the sheet.

BRIEF SUMMARY OF THE INVENTION

According to an aspect of the present invention, there is provided a heating apparatus comprising:

a heating member including a conductive layer having a first conductive member positioned in a first area and a second conductive member positioned in a second area which is at least partially different from the first area; and an induction heating unit including one coil and a control unit which controls a frequency of a high-frequency current to be supplied to the coil, the induction heating unit induction-heating the conductive layer by a magnetic field generated from the coil, wherein the first conductive member has a property of a skin resistance $Rs \geqq 4.7\times10^{-5}$ (Ω), and the second conductive member has a property of a skin resistance $Rs \geqq 88\times10^{-5}$ (Ω) in a skin resistance of $$Rs = \frac{\rho}{\delta} = \sqrt{4\times\pi^2\times10^{-7}}\times\sqrt{f\cdot\mu\cdot\rho},$$

wherein ρ (Ω·m) denotes a resistivity of the conductive member,

μ denotes a relative permeability of the conductive member, and f (Hz) denotes the frequency of the high-frequency current flowing through the coil at a time when the frequency f of the high-frequency current which flows through the coil is in a range of 20 kHz to 30 kHz.

According to another aspect of the present invention, there is provided a heating apparatus comprising:

a heating member including a conductive layer which loses magnetism at a temperature above a predetermined temperature;

a heating unit which includes one coil and which heats the conductive layer by induction heating; and a control unit which controls a frequency of a high-frequency current to be supplied to the coil in accordance with a change of a load resistance of the coil.

According to still another aspect of the present invention, there is provided an induction heating control method comprising:

induction-heating, by an induction heating unit including one coil, a heating member including a conductive layer having at least a first conductive member positioned in a first area and a second conductive member positioned in a second area which is different from the first area;

comparing, with a predetermined first defined temperature, a second temperature detected by a second temperature detecting element which detects a temperature of the second area;

comparing a first temperature detected by a first temperature detecting element which detects a temperature of the first area with a second defined temperature which is higher than the first defined temperature in a case where the second temperature is not more than the first defined temperature;

supplying, to the coil, a high-frequency current of a first frequency region which induction-heats the only first conductive member in a case where the first temperature is not less than the second defined temperature; and supplying, to the coil, a high-frequency current of a second frequency region which induction-heats both of the first conductive member and the second conductive member in a case where the first temperature is less than the second defined temperature.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 7 is a schematic diagram showing another example that is different from the fixing device shown in FIG. 1;

FIGS. 8A and 8B are schematic diagrams of the fixing device shown in FIG. 7 as viewed from a different direction;

DETAILED DESCRIPTION OF THE INVENTION

There will be described hereinafter an example of a fixing device to which an embodiment of this invention is applied with reference to the drawings.

First Embodiment

Figure 1:
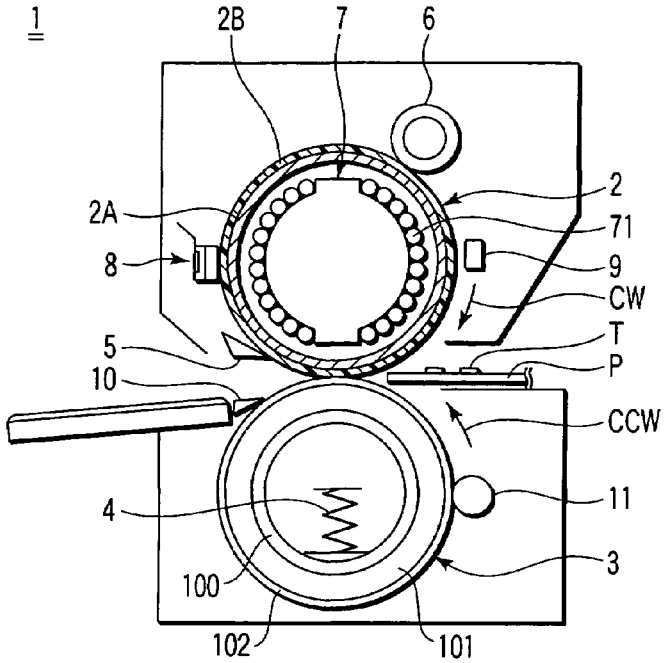
FIG. 1 is a schematic diagram showing one example of a fixing device to which an embodiment of the present invention is applicable.
Figure 2:
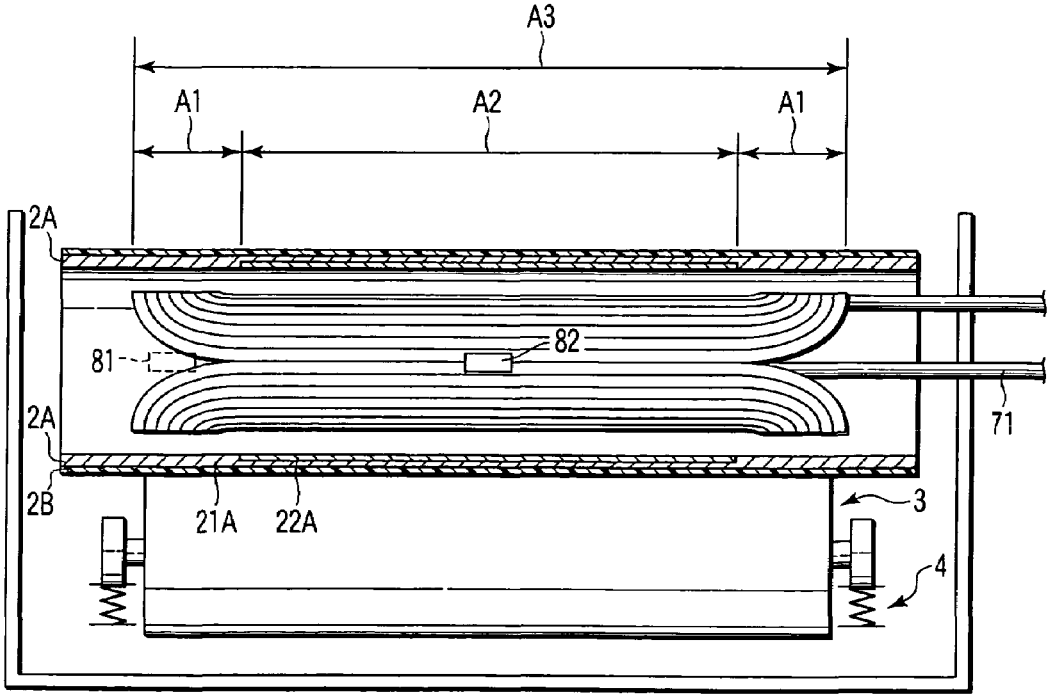
FIG. 2 is a schematic diagram of the fixing device shown in FIG. 1 as viewed from a different direction.

FIG. 1 shows one example of a fixing device to which an embodiment of this invention is applied. FIG. 2 is a schematic diagram of the fixing device shown in FIG. 1 as viewed from a different direction.

As shown in FIG. 1, a fixing device 1 has a heating member (heating roller) 2, a pressurizing member (pressurizing roller) 3, a pressurizing spring 4, a peeling claw 5, a cleaning roller 6, an induction heating unit 7, a temperature detecting section 8, and a thermostat 9.

The heating roller 2 includes a rolled conductive layer 2A constituted by forming a conductive material into a cylindrical shape, and a coating layer (mold-releasing layer) 2B disposed on an outer peripheral surface of this conductive layer 2A and made of a fluorine resin such as an ethylene tetrafluoride resin. This heating roller 2 has a 20 μm thick mold-releasing layer formed on the surface of the conductive layer 2A having a diameter of 40 mm and a thickness of 1 mm.

The pressurizing roller 3 is an elastic roller having a diameter of 40 mm. This pressurizing roller 3 is constituted of: a core metal 100 having a thickness of 1.5 mm; a 3 mm thick silicon rubber 101 formed on an outer periphery of this core metal 100; and a 30 μm thick PFA tube with which an outer periphery of this silicon rubber 101 is coated.

The pressurizing spring 4 comes into contact under a predetermined pressure with an axial line of the heating roller 2, and a predetermined nip is formed between the heating roller 2 and the pressurizing roller 3. This pressurizing spring 4 supplies a predetermined pressure from opposite ends of the pressurizing roller 3 via a pressurizing support bracket (not shown) which supports a shaft of the pressurizing roller 3.

The heating roller 2 is rotated in a clockwise direction shown by an arrow CW at a substantially constant speed by a predetermined fixing motor (not shown). When the heating roller 2 is rotated, the pressurizing roller 3 is rotated in a direction opposite to a direction in which the heating roller 2 is rotated in a position where the pressurizing roller comes into contact with the heating roller 2.

The peeling claw 5 peels, from the heating roller 2, a sheet P disposed in a downstream position of the nip in the heating roller 2 and passed through the nip. It is to be noted that the present invention is not limited to the present embodiment. For example, in a case where there is a large amount of developer to be fixed to the sheet as in color image formation, the sheet is not easily peeled from the heating roller 2. Therefore, a plurality of peeling claws 5 may be disposed. Alternatively, any peeling claw may not be disposed in a case where the sheet easily peels from the heating roller 2.

The cleaning roller 6 removes a toner offset on the surface of the heating roller 2, or dust such as waste paper.

The induction heating unit 7 is disposed in the heating roller 2, and includes a heating coil (exciting coil) 71 to which a predetermined power is supplied and which supplies a predetermined magnetic field to the heating roller 2. As shown in FIG. 2, the exciting coil 71 is one coil disposed at a substantially uniform distance from an inner surface of the heating roller 2, and the coil is constituted of one conductor. This exciting coil 71 generates a predetermined magnetic flux, when a predetermined high-frequency current is supplied to the coil by an induction heating control circuit described later in detail with reference to FIG. 3, and the heating roller 2 is induction-heated at a predetermined temperature.

As the exciting coil 71, a litz wire is usable which is constituted by bundling a plurality of copper wires whose surfaces are coated with an insulating material (e.g., heat-resistant polyamide imide). In the present embodiment, the litz wire is used which is constituted by bundling 50 copper wires having a linear diameter of 0.3 mm. In a case where a frequency of the high-frequency current to be supplied to the exciting coil 71 is high, a depth of penetration of an eddy current is further reduced, the eddy current flowing through the conductive layer 2A of the heating roller 2. This increases a copper loss. Therefore, when the linear diameter of the copper wire for use in the exciting coil 71 is reduced, the copper loss can be reduced, and an alternating current can be efficiently passed through the exciting coil 71.

The temperature detecting section 8 includes thermistors 81, 82 which detect a surface temperature of the heating roller 2 in two portions of the heating roller 2 along a longitudinal direction. The thermistor 81 detects the temperature of each area A1 described later. The thermistor 82 detects a temperature of an area A2.

The thermostat 9 detects heat generation abnormality indicating that the surface temperature of the heating roller 2 rises at an abnormal temperature. In a case where the heat generation abnormality is generated, the thermostat is used in order to interrupt a power supplied to the exciting coil 71.

Moreover, along a periphery of the pressurizing roller 3, there are arranged: a peeling claw 10 which peels the sheet P from the pressurizing roller 3; and a cleaning roller 11 which removes a toner attached to a peripheral surface of the pressurizing roller 3 in the same manner as in the heating roller 2.

When the sheet P holding a toner T is passed through a nip portion formed between the heating roller 2 and the pressurizing roller 3, the melted toner T is attached to the sheet P under pressure, and an image on the sheet P is fixed to the sheet P.

Next, the heating roller 2 will be described in more detail with reference to FIG. 2.

The conductive layer 2A includes the whole sheet passing area A3 constituted of the end areas (first areas) A1 and the central area (second area) A2. The central area A2 is an area through which a small-sized sheet is passed, and each end area A1 is adjacent to the central area A2 in the longitudinal direction of the heating roller 2. The central area A2 has a length of 180 mm, the whole sheet passing area A3 has a length of 300 mm, and the heating roller 2 has the whole length of 340 mm. It is to be noted that the whole sheet passing area A3 is a sheet passing area, and a further outer area of the whole sheet passing area A3 is referred to as a sheet non-passing area.

The central area A2 has a double-layer structure including a first conductive member 21A and a second conductive member 22A. A thickness of the conductive layer 2A is formed to be uniform in the longitudinal direction. In the second area A2 of the conductive layer 2A, the second conductive member 22A is disposed on a side close to the exciting coil 71 in the laminated first conductive member 21A and second conductive member 22A.

In the present embodiment, the first conductive member 21A is made of aluminum, and the second conductive member 22A is made of iron. A magnetic permeability of the first conductive member 21A made of aluminum is smaller than that of the second conductive member 22A made of iron. In other words, the second conductive member 22A made of iron generates a larger amount of heat by the eddy current as compared with the first conductive member 21A made of aluminum. Therefore, the second conductive member 22A made of iron can generate heat in a state in which the frequency of the high-frequency current to be supplied to the exciting coil 71 is low as compared with the first conductive member 21A made of aluminum.

As described above, since the first conductive member 21A made of aluminum has a magnetic permeability smaller than that of the second conductive member 22A made of iron, the first conductive member does not easily generate heat in a frequency region (around 20 kHz) where iron generates heat, and can generate sufficient heat in a higher frequency region (around 60 kHz). That is, assuming that a first frequency region F1 is below 40 kHz, the only second conductive member 22A made of iron can be induction-heated in this first frequency region F1. Assuming that a second frequency region F2 is not less than 40 kHz, it is possible to induction-heat both of the second conductive member 22A made of iron and the first conductive member 21A made of aluminum in this second frequency region F2.

When the frequency of the high-frequency current to be supplied to the exciting coil 71 is set to be high in this manner, the depth of penetration of the eddy current flowing through the conductive material (metal) can be set to be small (shallow). Therefore, an eddy current's property of flowing through the surface of a conductor is strengthened, and a current density increases. This increases the amount of heat to be generated. Consequently, the conductive member (aluminum) having a smaller magnetic permeability induction-heats the conductive member (iron) having a larger magnetic permeability. Therefore, when supplying, to the exciting coil 71, the high-frequency current whose frequency is higher than that of the high-frequency current to be supplied to the exciting coil 71, heat generation efficiency is improved.

It is to be noted that in a case where the alternating current flows through the conductor, the flowing current is not necessarily distributed with a certain density over the whole sectional area. The alternating current flows through a portion having a small impedance, that is, the surface of the conductor in a concentrated manner. A phenomenon in which the current eccentrically flows through the surface, and the current density of the surface increases in this manner is generally referred to as a skin effect. This phenomenon appears with respect to the alternating current. The higher the frequency is, the more remarkably the phenomenon appears. This depth of penetration is generally represented by the following equation, and can indicate a degree of concentration of the current onto this surface.

Penetration depth $$\delta = 503 \times \sqrt{\frac{\rho}{\mu f}}\ (m),$$

wherein ρ: resistivity [Ω·m] of the conductor;

μ: relative permeability of the conductor; and f: frequency (Hz) of the high-frequency current flowing through the exciting coil.

Moreover, a characteristic indicating heat generation in the high-frequency region can be represented based on a value of a skin resistance Rs represented by the following equation:

$$Rs = \frac{\rho}{\delta} = \sqrt{4 \times \pi^2 \times 10^{-7}} \times \sqrt{f \cdot \mu \cdot \rho}. \qquad \text{(Equation 1)}$$

It is to be noted that it has been experimentally clarified in the present embodiment that the conductive material having the following value of skin resistance Rs at each frequency (f) is suitable for induction heating:

$$Rs \geqq 8.0 \times 10^{-5} \ldots \qquad \text{(Equation 2).}$$

For example, in a case where the frequency is 20 kHz, the skin resistance Rs of iron is as follows, and the induction heating is possible:

$$Rs \geqq 88 \times 10^{-5}\ (\Omega) \ldots \qquad \text{(Equation 3).}$$

On the other hand, the skin resistance Rs of aluminum at a frequency of 20 kHz is as follows, and the induction heating is difficult:

$$Rs \geqq 4.7\times10^{-5}\ (\Omega)\ \ldots \qquad \text{(Equation 4).}$$

That is, at the frequency of 20 kHz, iron sufficiently generates heat by the induction heating, but aluminum does not easily generate heat. That is, aluminum having a magnetic permeability which is lower than that of iron does not easily generate heat in the vicinity of the frequency (20 kHz) in which iron generates heat. It is to be noted that to allow aluminum to generate heat in the vicinity of the above-described frequency (around 20 kHz), a thickness of a film of aluminum has to be set to be considerably small. This requires much manufacturing labor. Since the film thickness is considerably small, durability degrades, and the film might be broken.

Therefore, when increasing the frequency of the conductive material whose skin resistance value does not satisfy Equation 2, such as aluminum, the depth of penetration is reduced. Therefore, heat can be generated by the induction heating. Aluminum satisfies Equation 2 described above at a frequency of 60 kHz or more, and generates heat.

It is to be noted that in a case where the frequency is 60 kHz, even iron having a magnetic permeability which is larger than that of aluminum can generate heat by the induction heating. Therefore, when the frequency of the high-frequency current to be supplied to the exciting coil 71 is set to 60 kHz or more, heat can be generated from both of aluminum and iron by the induction heating.

Next, there will be described a constitution of an induction heating control circuit applicable to the fixing device 1 shown in FIG. 1, and a method of operating the fixing device 1.

Figure 3:
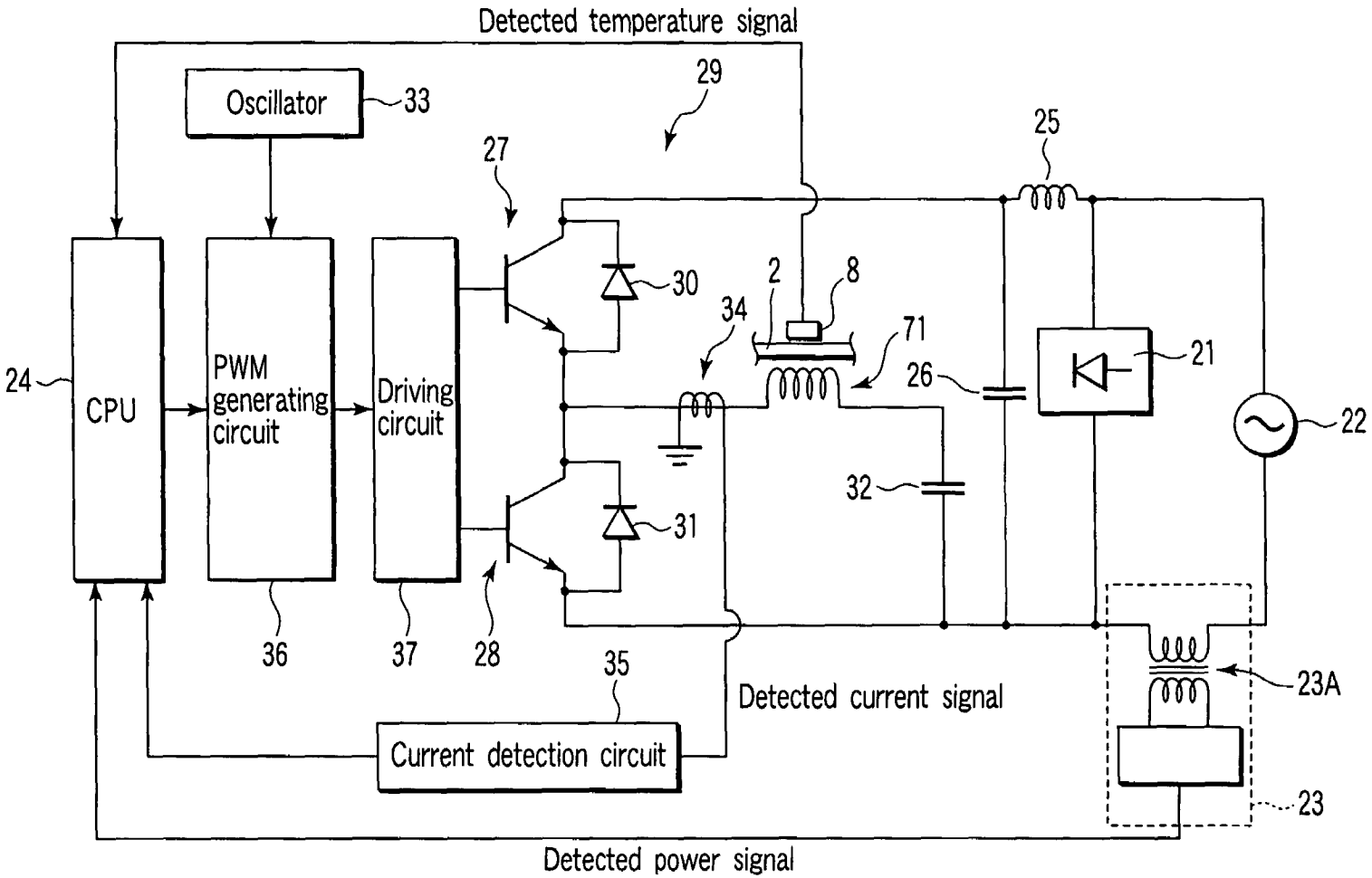
FIG. 3 is a block diagram showing a control system of the fixing device shown in FIG. 1.

FIG. 3 is a block diagram showing a control system of the fixing device shown in FIG. 1.

As shown in FIG. 3, this induction heating control circuit includes: a rectifying circuit 21; a commercial alternating-current power supply 22; an input power detecting section 23; a CPU 24; a reactor 25; a smoothing capacitor 26; an IGBT 27; an IGBT 28; an inverter circuit 29; a diode 30; a diode 31; a resonance capacitor 32; an oscillator 33; a current transformer (high-frequency current detecting means) 34; a current detection circuit (input current value detecting means, regenerative current value detecting means) 35; a PWM generation circuit 36; a driving circuit 37; the exciting coil 71; and the temperature detecting section 8. It is to be noted that the commercial alternating-current power supply 22 supplies a power to operate the fixing device 1, and the power supply may supply a part of a power to be supplied to the whole copying machine on which the fixing device 1 is to be mounted.

The rectifying circuit 21 is connected to the commercial alternating-current power supply 22, and also connected to the smoothing capacitor 26 via the reactor 25. The input power detecting section 23 is connected between the rectifying circuit 21 and the commercial alternating-current power supply 22 via a transformer 23A, and the input power detecting section 23 is connected to the CPU 24.

Arms constituted of the IGBTs 27 and 28 are connected to opposite ends of the smoothing capacitor 26 to constitute the inverter circuit 29 of a half bridge type (current resonance type). The diodes 30 and 31 are connected between collectors and emitters of the IGBTs 27 and 28, respectively. An output terminal of the inverter circuit 29 is connected to one end of the exciting coil 71 for generating a high-frequency magnetic field, and the other end of the exciting coil 71 is connected to the resonance capacitor 32.

The current detection circuit 35 is connected between the output terminal of the inverter circuit 29 and the exciting coil 71 via the current transformer 34, and the current detection circuit 35 is connected to the CPU 24. The CPU 24 is also connected to the temperature detecting section 8, and the CPU is further connected to the inverter circuit 29 via the PWM generation circuit 36 and the driving circuit 37.

There is supplied, to the inverter circuit 29, a direct-current power from the commercial alternating-current power supply 22, the power being smoothed by the rectifying circuit 21. The input power detecting section 23 detects the whole power consumption to be supplied from the commercial alternating-current power supply 22 to the inverter circuit 29 via the transformer 23A, and the section outputs, to the CPU 24, a detected power signal corresponding to the whole power consumption. The current detection circuit 35 detects the high-frequency current supplied from the inverter circuit 29 to the exciting coil 71 via the current transformer 34, and the circuit outputs, to the CPU 24, a detected current signal corresponding to this high-frequency current. The temperature detecting section 8 detects a surface temperature of the heating roller 2 induction-heated by the exciting coil 71, and outputs a detected temperature signal (voltage value).

The CPU 24 executes a control based on at least one of the detected power signal output from the input power detecting section 23, the detected current signal output from the current detection circuit 35, and the detected temperature signal output from the temperature detecting section 8, so that the surface temperature of the heating roller 2 becomes uniform in the longitudinal direction. There are simultaneously supplied, to the PWM generation circuit 36, a control signal from the CPU 24 and an oscillation signal output by the oscillator 33 based on a fixed frequency (driving frequency). The PWM generation circuit controls the driving circuit 37 to drive the inverter circuit 29. Accordingly, the driving circuit 37 outputs a gate signal (on and off signal) based on a predetermined driving frequency to gates of the IGBTs 27 and 28 of the inverter circuit 29. The inverter circuit 29 can generate a high-frequency power having a frequency corresponding to the driving frequency.

When the high-frequency current is supplied from the inverter circuit 29 to the exciting coil 71, a magnetic field is generated in accordance with the frequency of the high-frequency current, and the eddy current flows through the conductive layer 2A of the heating roller 2 to which this magnetic field has been supplied. Accordingly, the Joule heat is generated in the conductive layer 2A, and the heating roller 2 generates heat.

In the present embodiment, the CPU 24 indicates a driving frequency of 60 kHz to the inverter circuit 29, and supplies, to the exciting coil 71, the high-frequency current in accordance with this frequency in a case where the fixing device 1 or an image forming device (not shown) on which this fixing device 1 is mounted is started, in a case where a sheet (sheet having an A4 or A3 size) is passed through the whole sheet passing area A3 of the heating roller 2, or until a temperature of the heating roller 2 reaches a set temperature (e.g., 180° C.).

It is to be noted that in the present embodiment, the induction heating control circuit has a range of 20 to 70 kHz as a driving frequency region to be indicated to the inverter circuit 29. If the frequency is in this range, the driving frequency of the inverter circuit 29 can be arbitrarily changed.

Next, there will be described an induction heating control method based on a temperature detection signal from the temperature detecting section 8 with reference to FIG. 4.

As described above, the CPU 24 drives the inverter circuit 29 at the driving frequency of 60 kHz. The high-frequency current generated by the inverter circuit 29 is supplied to the exciting coil 71. Accordingly, the heating roller 2 is induction-heated, and the surface temperature (center) of the heating roller 2 is detected by the thermistor 82. The temperature detected by this thermistor 82 is compared with a set temperature of 180° C. (S1). When the temperature detected by the thermistor 82 is 180° C. or less (S1-YES), the surface temperature (end portion) of the heating roller 2 is detected by the thermistor 81. The temperature detected by this thermistor 81 is compared with a temperature of, for example, 200° C., which is higher than the set temperature by a predetermined temperature (S2). When the temperature detected by the thermistor 81 is below 200° C. (S2—NO), the driving frequency of the inverter circuit 29 is successively controlled into 60 kHz (S3), and the high-frequency current is supplied to the exciting coil 71 in accordance with this driving frequency of 60 kHz (S4).

On the other hand, when the temperature detected by the thermistor 81 is 200° C. or more in the step S2 (S2—YES), the driving frequency of the inverter circuit 29 is controlled into 30 kHz (S5), and the high-frequency current is supplied to the exciting coil 71 in accordance with this driving frequency of 30 kHz (S6).

It is to be noted that in a case where the temperature detected by the thermistor 82 is higher than 180° C. in the step S1 (S1-NO), the power supply from the commercial alternating-current power supply 22 is interrupted, and the induction heating is stopped (S7).

As described above, in the induction heating control method of the present embodiment, when the temperature detected by the thermistor 81 disposed in the end portion of the heating roller 2 in the longitudinal direction is above 200° C., the driving frequency of the inverter circuit 29 is changed from 60 kHz around 30 kHz. Accordingly, the depth of penetration in the conductive layer 2A of the heating roller 2 increases, and the second conductive member 22A made of iron generates heat, but the first conductive member 21A made of aluminum does not generate any heat. Therefore, since the only second conductive member 22A generates heat, the only vicinity of the center of the heating roller 2 is heated, and it is possible to prevent the temperature of the end portion of the heating roller 2 from being excessively raised. In a case where the temperature detected by the thermistor 81 is below 200° C., the driving frequency of the inverter circuit 29 is set to 60 kHz.

As described above, when the driving frequency of the inverter circuit 29 is changed, it is possible to change the frequency of the high-frequency current to be supplied to the exciting coil 71. Therefore, it is possible to change the depth of penetration of the eddy current flowing through the conductive layer 2A of the heating roller 2, and the only conductive member corresponding to this depth of penetration can be induction-heated. Therefore, as in the present embodiment, the driving frequency can be changed to change the heat generating area of the heating roller 2 by use of the conductive member having a different driving frequency region in which heat is generated.

Therefore, during continuous printing of, for example, a small-sized sheet, even in a case where the temperature rises in the only end portions of the heating roller 2 that do not pass the small-sized sheet, the induction heating of the only end portions of the heating roller 2 can be stopped, and the induction heating of the center of the heating roller 2 can be continued. Based on the detected temperature signal from the temperature detecting section 8, the method of the present embodiment controls heat generation of the first conductive member 21A and the second conductive member 22A for use in the conductive layer 2A of the heating roller 2. That is, the driving frequency output from the inverter circuit 29 can be changed to make uniform the surface temperature of the heating roller 2 along the longitudinal direction.

Moreover, when a plurality of conductive members are disposed in accordance with the driving frequency even in the fixing device including only one exciting coil as in the present embodiment, heating areas of a plurality of heating rollers 2 can be constituted. Therefore, since the exciting coils or the driving circuits do not have to be increased in accordance with the number of the heating areas, manufacturing costs can be reduced.

Furthermore, the induction heating control method usable in the present invention is not limited to the method described with reference to FIG. 4, and there may be performed a method of changing the driving frequency of the inverter circuit 29 from 60 kHz around 30 kHz, for example, in a case where a difference between the temperature of the central area A2 of the heating roller 2 and the temperature of each end area A1 is in a predetermined defined range (e.g., 20° C.).

Second Embodiment

Figure 4:
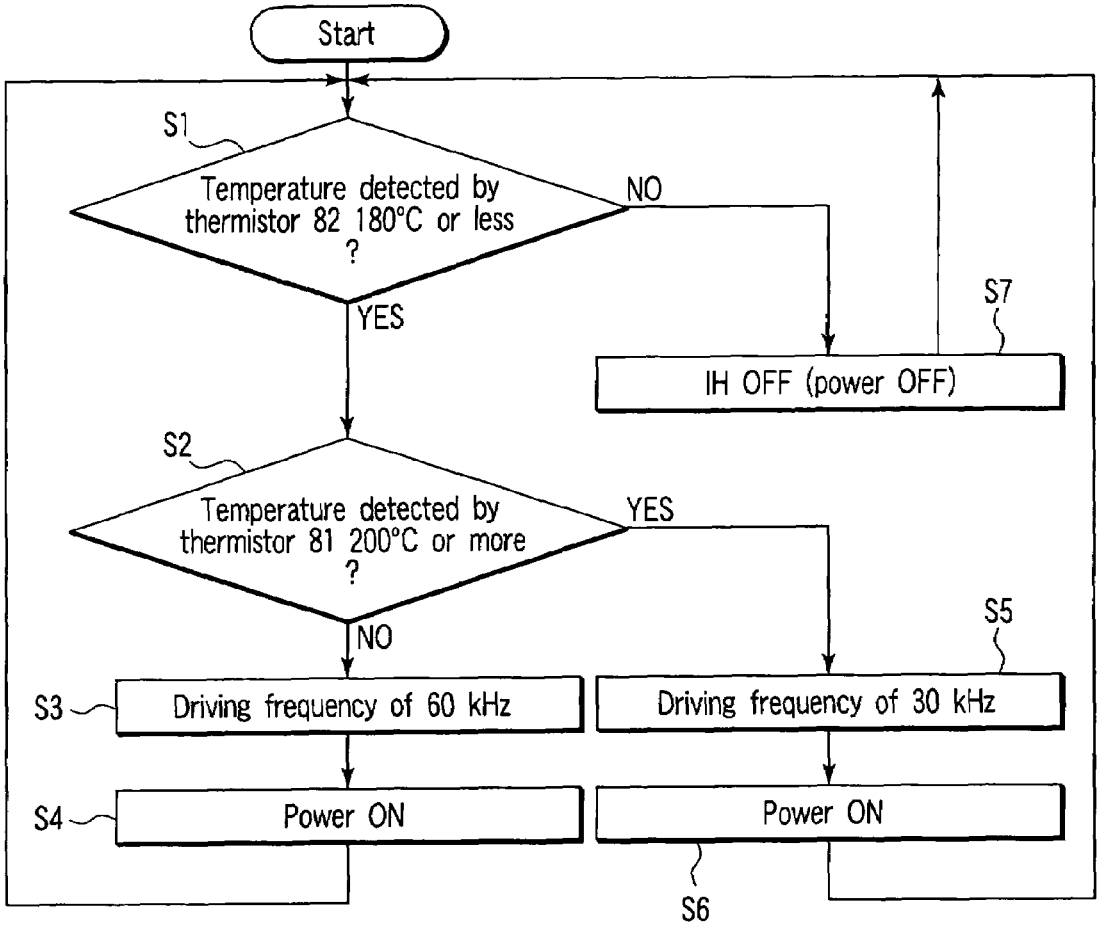
FIG. 4 is a flowchart showing one example of a heating apparatus control method which is applicable to the fixing device shown in FIG. 1.
Figure 5:
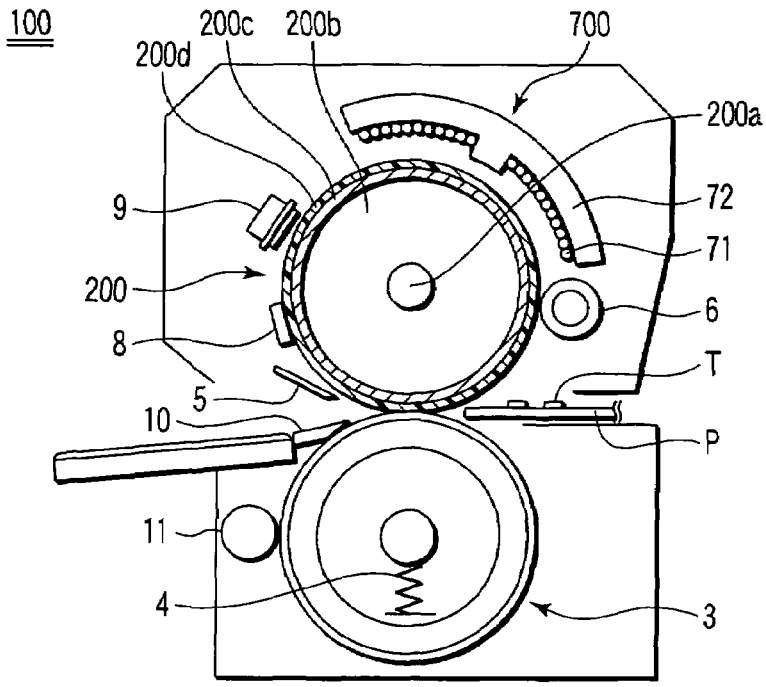
FIG. 5 is a schematic diagram showing an example that is different from the fixing device shown in FIG. 1.
Figure 6:
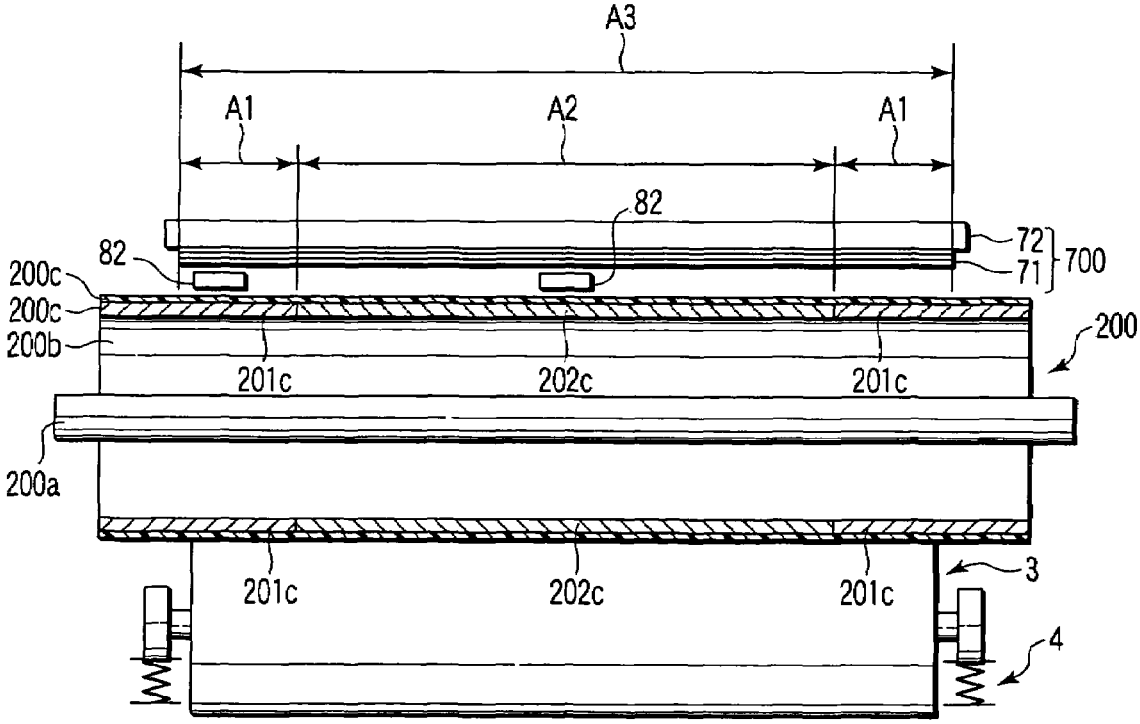
FIG. 6 is a schematic diagram of the fixing device shown in FIG. 5 as viewed from a different direction.

Next, there will be another example of the first embodiment with reference to FIGS. 5 and 6. FIG. 5 shows an example of a fixing device to which the present embodiment is applicable. FIG. 6 shows a schematic diagram of the fixing device shown in FIG. 5 as viewed from a different direction. It is to be noted that components having the same constitutions and functions as those of components shown in FIGS. 1 to 4 are denoted with the same reference numerals, and detailed description thereof is omitted.

As shown in FIG. 5, a fixing device 100 has a heating roller 200, an induction heating unit 700, a pressurizing roller 3, a pressurizing spring 4, a peeling claw 5, a cleaning roller 6, a temperature detecting section 8, and a thermostat 9.

The heating roller 200 has: a shaft 200*a* made of a material having a rigidity (hardness) such that the material does not deform under a predetermined pressure; an elastic layer (a foam rubber layer, a sponge layer, and a silicon rubber layer) 200*b* disposed around this shaft 200*a*; a conductive layer 200*c*; and a mold-releasing layer 200*d*.

As shown in FIG. 6, the conductive layer 200*c* includes: a second area A2 through which a small-sized sheet is passed; first areas A1 disposed adjacent to opposite ends of the second area A2 in a longitudinal direction of the heating roller 200; and the whole sheet passing area A3 including the first areas A1 and the second area A2.

The conductive layer 200*c* includes: first conductive members 201*c* positioned in the first areas A1; and a second conductive member 202*c* positioned in the second area A2. In the present embodiment, the conductive layer 200*c* is made of the same conductive material in a thickness direction, and made of different conductive materials in the longitudinal direction. That is, different conductive materials are utilized in the conductive members disposed in the first areas A1 and the second area A2, and portions which connect the first conductive members 201*c* to the second conductive member 202*c* are disposed in the vicinity of boundaries between the first areas A1 and the second area A2. For example, the first conductive members 201*c* are made of aluminum, and the second conductive member 202*c* is made of iron. The mold-releasing layer 200*d* is a thin film layer made of, for example, a heat-resistant silicon rubber, and a length of the heating roller 200 along the longitudinal direction is 330 mm.

The induction heating unit 700 is disposed externally along the heating roller 200, and connected to the induction heating control circuit described above with reference to FIG. 3. The induction heating unit includes: an exciting coil 71 to which a predetermined power is supplied and which supplies a predetermined magnetic field to the heating roller 220; and a magnetic core 72. It is to be noted that as the exciting coil 71, a litz wire is usable which is constituted by bundling a plurality of copper wires having surfaces coated with an insulating material as described above. The magnetic core 72 can generate a magnetic flux in a concentrated manner. Consequently, the number of windings (turns) of the exciting coil 71 can be reduced, and the induction heating unit 700 can efficiently and locally heat a predetermined area of the heating roller 200.

The fixing device 100 constituted in such manner is controlled by the induction heating control circuit shown in FIG. 3 in the same manner as in the first embodiment. It is possible to apply an induction heating control method based on a temperature detection signal as shown in FIG. 4. Therefore, a driving frequency can be changed to thereby select the conductive member to be induction-heated in the same manner as in the first embodiment. Therefore, when the driving frequency is set around 20 kHz, the only second conductive member 202*c* made of iron can be induction-heated to generate heat. When the driving frequency is set to 60 kHz or more, it is possible to induction-heat both of the second conductive member 202*c* made of iron and the first conductive members 201*c* made of aluminum to thereby generate heat.

Therefore, during continuous printing of, for example, a small-sized sheet, even in a case where the temperature rises in the only end portions of the heating roller 200 that do not pass this small-sized sheet, the induction heating of the only end portions of the heating roller 200 can be stopped, and the induction heating of the center of the heating roller 200 can be continued. Accordingly, based on a detected temperature signal from the temperature detecting section 8, the method of the present embodiment controls heat generation of the first conductive members 201*c* and the second conductive member 202*c* for use in the conductive layer 200*c* of the heating roller 200, so that the surface temperature of the heating roller 200 along a longitudinal direction can be set to be uniform.

It is to be noted that in the present embodiment, a distance between the exciting coil 71 and an outer peripheral surface of the heating roller 200 is set to approximately 3 mm.

Third Embodiment

Next, there will be described another example of a first embodiment with reference to FIGS. 7, 8A, and 8B. FIG. 7 shows an example of a fixing device to which the present embodiment is applicable. FIGS. 8A and 8B show schematic diagrams of a heating roller 220 which is applicable to the fixing device shown in FIG. 7.

As shown in FIG. 7, a fixing device 120 includes: a fixing belt 12; the heating roller 220; a pressurizing roller 321; a fixing roller 322; and an induction heating unit 720.

The induction heating unit 720 is disposed externally along the heating roller 220, and the fixing belt 12 is sandwiched between the induction heating unit and the heating roller 220. The induction heating unit is connected to an induction heating control circuit described above with reference to FIG. 3, and includes: an exciting coil 721 to which a predetermined power is supplied and which supplies a predetermined magnetic field to the heating roller 220; and a magnetic core 722.

The fixing belt 12 is an endless member extended externally between the heating roller 220 and the fixing roller 322 while keeping its predetermined tensile force. The fixing belt 12 includes: a base member 121 made of a resin or the like having a resistance to thermal stress; and an elastic layer 122 and a mold-releasing layer 123 disposed in order externally along the base material 121, that is, the heating roller 220. In the present embodiment, the base member 121 is made of a polyimide resin having a thickness of 40 μm, the elastic layer 122 is made of a silicon rubber having a thickness of 300 μm, and the mold-releasing layer 123 is made of a fluorine resin having a thickness of 30 μm. In the present embodiment, a peripheral length of the fixing belt 12 is set so that the belt has a diameter of 70 mm.

The pressurizing roller 321 is constituted of: a shaft made of a material having a rigidity (hardness) such that the material does not deform under a predetermined pressure; and an elastic layer (fluorine rubber layer, silicon rubber layer) disposed around this shaft, and the pressurizing roller supplies the predetermined pressure to the fixing roller 322.

The fixing roller 322 retains the fixing belt 12 together with the heating roller 220 while applying a predetermined tension to the fixing belt 12, and is given the predetermined pressure from the pressurizing roller 321. In the present embodiment, the fixing roller 322 is made of foam silicon sponge whose surface has low hardness and elasticity.

Accordingly, a nip having a predetermined width is formed between the fixing roller 322 and the pressurizing roller 321.

The fixing roller 322 is rotated in a direction shown by an arrow CW at an approximately constant speed by a predetermined fixing motor (not shown). The pressurizing roller 321 is brought into contact with the fixing roller 322 under a predetermined pressure by a predetermined pressurizing mechanism (not shown). Therefore, when the fixing roller 322 is rotated, the pressurizing roller 321 is rotated in a counterclockwise direction shown by an arrow CCW, the direction being opposite to a direction in which the fixing roller 322 is rotated, in a position where the pressurizing roller comes into contact with the fixing roller 322. The fixing belt 12 is moved with the rotation of this fixing roller 322, and the heating roller 220 is rotated with the movement of this fixing belt 12.

When a high-frequency current having a predetermined frequency is supplied to the exciting coil 721 connected to the induction heating control circuit shown in FIG. 4, a magnetic field is generated from the exciting coil 721 in accordance with the frequency of the high-frequency current, and an eddy current flows through a conductive layer 220A of the heating roller 220 to which this magnetic field has been supplied. Accordingly, the Joule heat is generated in the conductive layer 220A, and the heating roller 220 generates heat. Moreover, the fixing belt 12 brought into contact with the heating roller 220 which has generated heat is warmed by conduction of heat. A toner T on a sheet P passes through a nip formed between the pressurizing roller 321 and the fixing roller 322, and is accordingly melted by this warmed fixing belt 12. The melted toner T is attached to the sheet P under pressure, and an image on the sheet P is fixed to the sheet P.

Moreover, in the fixing belt 12, a temperature detecting section 801 is disposed which detects a temperature of the surface of the fixing belt 12. The temperature detecting section 801 includes: a first thermistor (not shown) which detects a surface temperature of each end area of the fixing belt 12 facing each end area A1 of the heating roller 220; and a second thermistor (not shown) which detects a surface temperature of a central area of the fixing belt 12 facing a central area A2 of the heating roller 220. The present invention is not limited to this embodiment, and the temperature detecting section may include, for example, a third thermistor (not shown) which detects a surface temperature of a sheet non-passing area of the fixing belt 12.

The heating roller 220 will be described in more detail. As shown in FIG. 8A, the heating roller 220 includes: the central area A2 through which a small-sized sheet is passed; the end areas A1 adjacent to opposite ends of the central area A2 in a longitudinal direction of the heating roller 2; and the whole sheet passing area A3 including the end areas A1 and the second area A2. The heating roller 220 includes the conductive layer 220A constituted of a first conductive member 221A positioned in at least the end area A1 and a second conductive member 222A positioned in the central area A2. For example, this first conductive member 221A is positioned in the whole sheet passing area A3 including the end areas A1 and the central area A2, and the second conductive member 222A is positioned in the only central area A2. That is, the central area A2 has a double-layer structure of the first conductive member 221A and the second conductive member 222A. It is to be noted that the conductive layer 220A has a thickness of, for example, 0.5 mm, and the thickness is formed to be approximately uniform. In the second area A2 of the conductive layer 220A, the second conductive member 222A is disposed on a side close to the exciting coil 721 in the laminated first conductive member 221A and second conductive member 222A.

That is, in the central area A2 of this conductive layer 220A having a laminated structure, the second conductive member 222A is disposed on the side close to the exciting coil 721. Here, unlike the fixing device 1 shown in FIG. 2, the fixing device 120 has a constitution in which the induction heating unit 720 is disposed externally along the heating roller 220. Therefore, as shown in FIG. 8A, the second conductive member 222A is disposed in an outer part of the conductive layer 220A in the central area A2 of the conductive layer 220A.

In the fixing device 120 constituted in this manner, the first thermistor is regarded as the thermistor 81 shown in FIG. 1, the second thermistor is regarded as the thermistor 82 shown in FIG. 1, and it is possible to apply an induction heating control method based on a temperature detection signal as shown in FIG. 4. That is, a driving frequency can be changed to thereby select the conductive member to be induction-heated in the same manner as in the first embodiment.

Therefore, when the driving frequency is set around 20 kHz, the only second conductive member 222A made of iron can be induction-heated to thereby generate heat. When the driving frequency is set to 60 kHz or more, it is possible to induction-heat both of the second conductive member 222A made of iron and the first conductive members 221A made of aluminum to thereby generate heat.

Therefore, during continuous printing of, for example, a small-sized sheet, even in a case where the temperature rises in the only end portions of the heating roller 220 that do not pass this small-sized sheet, the induction heating of the only end portions of the heating roller 220 can be stopped, and the induction heating of the center of the heating roller 220 can be continued. Accordingly, based on a detected temperature signal from the temperature detecting section 801, the method of the present embodiment controls heat generation of the first conductive member 221A and the second conductive member 222A for use in the conductive layer 220A of the heating roller 220, so that the surface temperature of the heating roller 220 along a longitudinal direction can be set to be uniform. In consequence, the temperature of the fixing belt 12 can be set to be uniform in the longitudinal direction.

It is to be noted that in the present embodiment, the first conductive member 221A of the conductive layer 220A is made of aluminum, and the second conductive member 222A is made of iron. The heating roller 220 is formed into a diameter of 20 mm, the fixing roller 322 is formed into a diameter of 30 mm, the whole length of the heating roller 220 in the longitudinal direction is set to 330 mm, and a length of the central area A2 in the longitudinal direction is set to 180 mm. Furthermore, a distance between the exciting coil 721 and an outer peripheral surface of the heating roller 220 is set to approximately 2 mm.

Moreover, the heating roller 220 shown in FIG. 7 may include a conductive layer 220C shown in FIG. 8B, The conductive layer 220C includes first conductive members 221C positioned in the end areas A1 and a second conductive member 222C positioned in the central area A2 in the same manner as in the conductive layer 200*c* shown in FIG. 6. As shown in FIG. 8B, the conductive layer 220C includes the same conductive material in a thickness direction, and includes different conductive materials in a longitudinal direction. The first conductive members 221C are made of aluminum, and the second conductive member 222C is made of iron. In the heating roller 220 having the conductive layer 220C constituted in this manner, there is applicable an induction heating control method based on a temperature detection signal shown in FIG. 4 in the same manner as in the heating roller 220 having the conductive layer 220A. Therefore, the driving frequency can be changed to thereby select the conductive member to be induction-heated.

Fourth Embodiment

Figure 9:
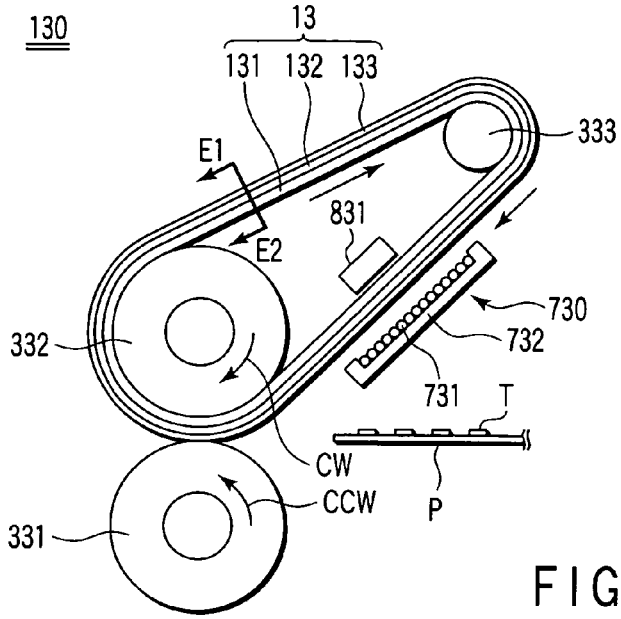
FIG. 9 is a schematic diagram showing still another example that is different from the fixing device shown in FIG. 1.
Figure 10:
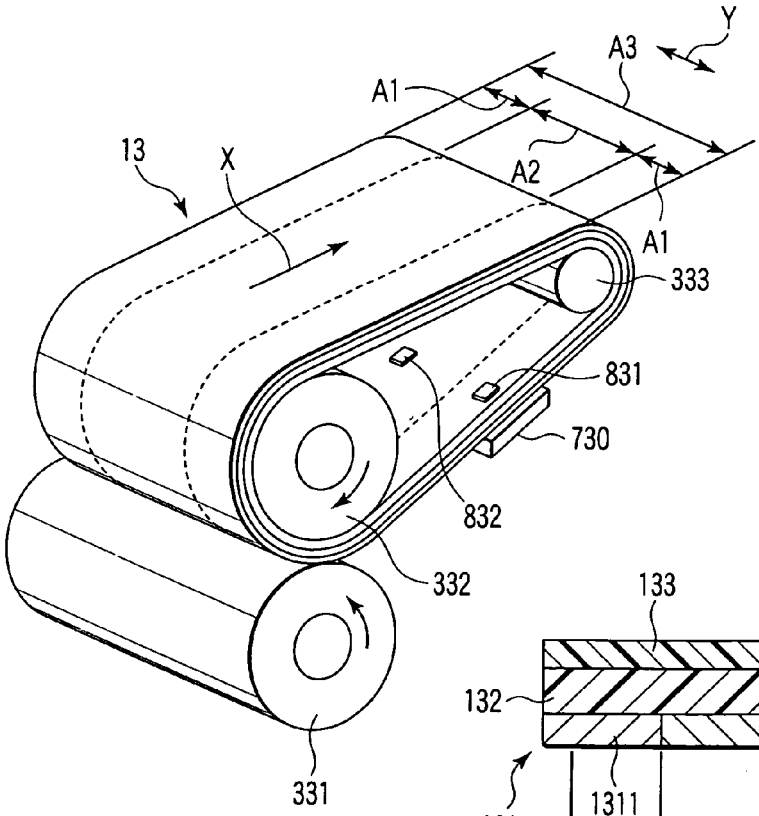
FIG. 10 is a schematic diagram of the fixing device shown in FIG. 9 as viewed from a different direction.
Figure 11:
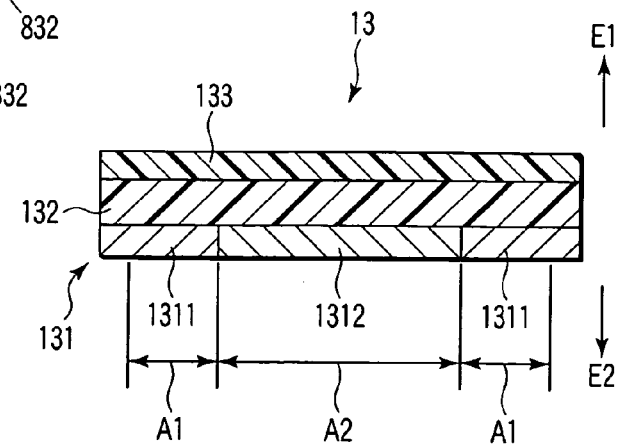
FIG. 11 is a sectional view cut along the arrows E1 and E2, showing a heating belt mounted on the fixing device shown in FIG. 9.

Next, there will be another example of the first embodiment with reference to FIGS. 9, 10, and 11. FIG. 9 shows an example of a fixing device to which the present embodiment is applicable. FIG. 10 shows a schematic diagram of the fixing device shown in FIG. 9 as viewed from a different direction. FIG. 11 is a sectional view cut along the arrows E1 and E2, showing a heating belt mounted on the fixing device shown in FIG. 9.

As shown in FIG. 9, a fixing device 130 includes: a heating belt 13; a pressurizing roller 331; a first fixing roller 332; a second fixing roller 333; an induction heating unit 730; and a temperature detecting section 831.

The induction heating unit 730 is disposed externally along the heating belt 13, and connected to an induction heating control circuit described above with reference to FIG. 3. The induction heating unit 730 includes: exciting coils 731 to which a predetermined power is supplied and which supplies a predetermined magnetic field to the heating belt 13; and a magnetic core 732. The exciting coils 731 are arranged at an equal distance from the heating belt 13.

The heating belt 13 is an endless member extended externally between the first fixing roller 332 and the second fixing roller 333 while keeping its predetermined tensile force. The heating belt 13 includes: a conductive layer 131; and an elastic layer 132 and a mold-releasing layer 133 disposed in order externally along this conductive layer 131.

The pressurizing roller 331 is constituted of: a shaft made of a material having a rigidity (hardness) such that the material does not deform under a predetermined pressure; and an elastic layer (a fluorine rubber layer, a silicon rubber layer) disposed around this shaft. The pressurizing roller 331 applies a predetermined pressure to the first fixing roller 332.

The first fixing roller 332 retains the heating belt 13 together with the second fixing roller 333 while applying a predetermined tension to the heating belt 13, and is given the predetermined pressure from the pressurizing roller 331.

The second fixing roller 333 is a cylindrical ceramic product (ceramics) formed into a diameter of, for example, 20 mm, and a thickness of 0.5 mm. However, the present invention is not limited to this embodiment, and the second fixing roller 333 may be made of, for example, iron, SUS430, SUS304, aluminum or the like.

Accordingly, a nip having a predetermined width is formed between the pressurizing roller 331 and the first fixing roller 332.

The first fixing roller 332 is rotated in a direction shown by an arrow CW at an approximately constant speed by a predetermined fixing motor (not shown). The pressurizing roller 331 is brought into contact with the first fixing roller 332 under a predetermined pressure by a predetermined pressurizing mechanism (not shown). Therefore, when the first fixing roller 332 is rotated, the pressurizing roller 331 is rotated in a direction (arrow CCW direction) opposite to a direction in which the first fixing roller 332 is rotated in a position where the pressurizing roller comes into contact with the first fixing roller 332. The heating belt 13 is moved with the rotation of this first fixing roller 332, and the second fixing roller 333 is rotated with the movement of this heating belt 13.

When a high-frequency current having a predetermined frequency is supplied to the exciting coils 731 connected to the induction heating control circuit shown in FIG. 4, a magnetic field is generated from the exciting coils 731 in accordance with the frequency of the high-frequency current, and an eddy current flows through a conductive layer 131 of the heating belt 13 to which this magnetic field has been supplied. Accordingly, the Joule heat is generated in the conductive layer 131, and the heating belt 13 generates heat. A toner T on a sheet P is melted by the heating belt 13. When the sheet passes through the nip formed between the pressurizing roller 331 and the first fixing roller 332, the melted toner T is attached to the sheet P under pressure, and an image on the sheet P is fixed to the sheet P.

Moreover, in the heating belt 13, the temperature detecting section 831 which detects a surface temperature of the heating belt 13 is disposed in a position facing the induction heating unit 730. As shown in FIG. 10, the temperature detecting section 831 includes: a first thermistor 831 which detects a surface temperature of each first conductive member 1311 of the heating belt 13 facing each end area A1; and a second thermistor 832 which detects a surface temperature of a second conductive member 1312 of the heating belt 13 facing a central area A2. The present invention is not limited to this embodiment, and the temperature detecting section may include, for example, a third thermistor (not shown) which detects a surface temperature of a sheet non-passing area of the heating belt 13.

The conductive layer 131 will be described in more detail. As shown in FIGS. 10 and 11, the conductive layer 131 includes: the central area A2 through which a small-sized sheet is passed; the end areas A1 adjacent to opposite ends of the central area A2 in a direction Y (hereinafter referred to as "longitudinal direction") crossing a moving direction X of the heating belt 13 at right angles; and the whole sheet passing area A3 including the end areas A1 and the central area A2.

As shown in FIG. 11, the heating belt 13 includes the conductive layer 131 constituted of the first conductive members 1311 positioned in the end areas A1 and the second conductive member 1312 positioned in the central area A2. The first conductive member 1311 is made of stainless steel (SUS303), and the second conductive member 1312 is made of nickel. These first conductive member 1311 and second conductive member 1312 are bonded to an elastic layer 132.

Furthermore, nickel can generate heat in a frequency region (around 20 kHz) in which iron generates heat. That is, the second conductive member 1312 made of nickel has a frequency region of 20 kHz or more. On the other hand, since nonmagnetic stainless steel has a low magnetic permeability, a heating efficiency is low with a high-frequency current of about 30 kHz, an amount of heat to be generated is small, and heat can be generated at 60 kHz or more. That is, the first conductive members 1311 made of nonmagnetic stainless steel does not easily generate heat in a frequency region (around 20 kHz) in which nickel generates heat, and the members can sufficiently generate heat in a higher frequency region (around 60 kHz). That is, when a first frequency region F1 is below 40 kHz, the only second conductive member 1312 made of nickel can be induction-heated in this first frequency region F1. When a second frequency region F2 is 40 kHz or more, it is possible to induction-heat both of the second conductive member 1312 made of nickel and the first conductive members 1311 made of nonmagnetic stainless steel in this second frequency region F2.

In the fixing device 130 constituted in this manner, the first thermistor 831 is regarded as the thermistor 81 shown in FIG. 1, the second thermistor 832 is regarded as the thermistor 82 shown in FIG. 1, and it is possible to apply an induction heating control method based on a temperature detection signal as shown in FIG. 4. That is, a driving frequency can be changed to thereby select the conductive member to be induction-heated in the same manner as in the first embodiment.

That is, when the driving frequency is set around 20 kHz, the only second conductive member 1312 made of nickel can be induction-heated to thereby generate heat. When the driving frequency is set to 60 kHz or more, it is possible to induction-heat both of the second conductive member 1312 made of nickel and the first conductive members 1311 made of nonmagnetic stainless steel to thereby generate heat.

Therefore, during continuous printing of, for example, a small-sized sheet, even in a case where the temperature rises in the only end portions of the heating belt 13 that do not pass this small-sized sheet, the induction heating of the only end portions of this heating belt 13 can be stopped, and the induction heating of the center of the heating belt 13 can be continued. Accordingly, based on a detected temperature signal from the temperature detecting section 831, the method of the present embodiment controls heat generation of the first conductive members 1311 and the second conductive member 1312 for use in the conductive layer 131 of the heating belt 13, so that the surface temperature of the heating belt 13 along a longitudinal direction can be set to be uniform.

Moreover, the present invention is not limited to this embodiment, and the central area A2 may have a constitution in which the first conductive member 1311 and the second conductive member 1312 are laminated as described above with reference to, for example, FIG. 2.

In the present embodiment, the conductive layer 131 is formed into a thickness of 40 μm, the elastic layer 132 is made of a silicon rubber having a thickness of 300 μm, and the mold-releasing layer 123 is made of a fluorine resin having a thickness of 30 μm. As stainless steel for use in the first conductive members 1311, a nonmagnetic material is used.

Fifth Embodiment

Figure 12:
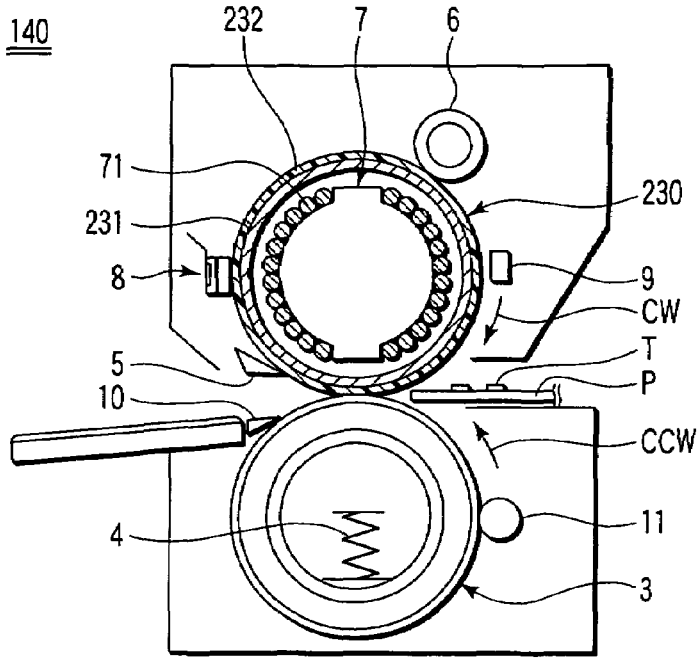
FIG. 12 is a schematic diagram showing a further example that is different from the fixing device shown in FIG. 1.
Figure 13:
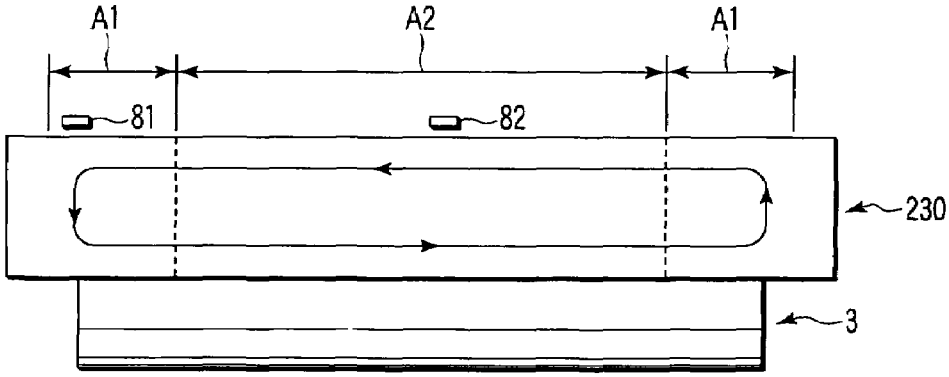
FIG. 13 is a schematic diagram of the fixing device shown in FIG. 12 as viewed from a different direction.
Figure 14:
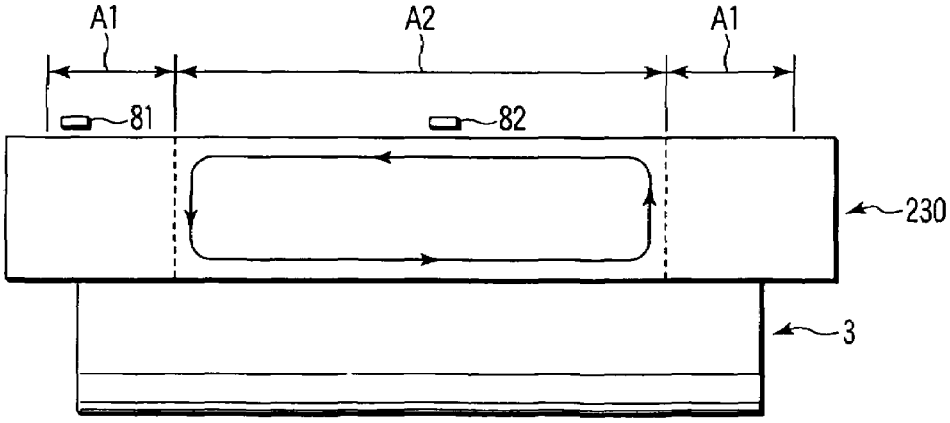
FIG. 14 is a schematic diagram of the fixing device shown in FIG. 12 as viewed from a different direction.

Next, there will be described another example of the first embodiment with reference to FIGS. 12, 13, and 14. FIG. 12 shows an example of a fixing device to which the present embodiment is applicable. FIGS. 13, 14 show schematic diagrams of the fixing device shown in FIG. 12 as viewed from a different direction. It is to be noted that components having the same constitutions and functions as those of components shown in FIGS. 1 to 4 are denoted with the same reference numerals, and detailed description is omitted.

As shown in FIG. 12, a fixing device 140 includes: a pressurizing roller 3; a pressurizing spring 4; a peeling claw 5; a cleaning roller 6; an induction heating unit 7; a temperature detecting section 8; a thermostat 9; and a heating roller 230.

The heating roller 230 includes: a rolled conductive layer 231 constituted by forming an adjusted magnetism alloy into a cylindrical shape; and a mold-releasing layer 232 disposed on an outer peripheral surface of this conductive layer 231 and made of a fluorine resin such as a ethylene tetrafluoride resin. It is to be noted that the adjusted magnetism alloy is an alloy having a characteristic that the alloy loses its magnetism at a raised temperature, and a temperature at which the alloy loses its magnetism is the Curie temperature (magnetism transition point).

The adjusted magnetic alloy for use in the conductive layer 231 is made of a composite alloy of nickel and iron, having the Curie temperature in the vicinity of a set temperature (e.g., 180° C.) of the fixing device 140. The adjusted magnetism alloy for use in this conductive layer 231 has a magnetic characteristic adjusted so that the magnetic characteristic (magnetic permeability) rapidly degrades at the Curie temperature. When the magnetic permeability degrades, the depth of penetration of an eddy current flowing through the conductive layer 231 increases (deepens), and a magnetic flux penetrates the pressurizing roller 321. Therefore, an electric resistance of the conductive layer 231 is reduced, generation of the Joule heat by the eddy current is reduced, and an amount of heat to be generated is also reduced.

In the present embodiment, the conductive layer 231 is made of the adjusted magnetism alloy whose Curie temperature has been adjusted into 200° C. As shown in FIGS. 13, 14, the conductive layer 231 includes a central area A2 through which a small-sized sheet is passed, and end areas A1 adjacent to the central area A2 in a longitudinal direction of the heating roller 2.

The induction heating unit 7 is connected to an induction heating control circuit shown in FIG. 3 as described above, and includes an exciting coil 71 to which a predetermined power is supplied and which supplies a predetermined magnetic field to the heating roller 230. Accordingly, a CPU 24 drives an inverter circuit 29 at a predetermined driving frequency, and a high-frequency current is generated from the inverter circuit 29 and supplied to the exciting coil 71, thereby induction-heating the conductive layer 231 of the heating roller 230.

As shown in FIGS. 13, 14, the temperature detecting section 8 includes a thermistor 81 which detects a surface temperature of each first area A1 which is an end portion of the heating roller 230, and a thermistor 82 which detects a surface temperature of the second area A2 which is the center of the heating roller 2.

As shown in FIG. 3, a current detection circuit 35 detects the high-frequency current supplied from the inverter circuit 29 to the exciting coil 71 via a current transformer 34, and outputs a detected current signal corresponding to this high-frequency current to the CPU 24. The CPU 24 can detect a change of an electric resistance of the conductive layer 231 by use of this current detection circuit 35. This will be described hereinafter.

When the conductive layer 231 reaches the Curie temperature as described above, the electric resistance of the conductive layer 231 is reduced. This weakens magnetic bonding between the conductive layer 231 and the exciting coil 71, and a load resistance of the exciting coil 71 is reduced. Therefore, the current flowing through the exciting coil 71 increases. When the current detection circuit 35 detects that the current flowing through this exciting coil 71 exceeds a defined range, the CPU 24 can detect that the electric resistance of the conductive layer 231 has changed.

When the temperature of the conductive layer 231 is lower than the Curie temperature, as shown in FIG. 13, the eddy current flowing through the conductive layer 231 flows through both of each end area A1 and the central area A2 of the conductive layer 231, and the whole layer is substantially uniformly heated. For example, at a warming-up time when the surface temperature of the heating roller 230 is heated at the set temperature, or in a case where an image is fixed to an A3 or A4 lateral size sheet passed through the whole sheet passing area including the end areas A1 and the central area A2, as shown in FIG. 13, the eddy current is flowed through the conductive layer 231, and the whole conductive layer 231 is substantially uniformly heated.

On the other hand, during continuous printing of a small-sized sheet (vertical A4, B5 or the like), even in a case where the temperature rises in the only end portions of the heating roller 230 that do not pass this small-sized sheet, and the temperature of each end area A1 of the heating roller 230 is above the Curie temperature of 200° C., the magnetic permeability of the end area A1 of the conductive layer 231 degrades. This increases the depth of penetration of the eddy current flowing through the end portions of the conductive layer 231. As shown in FIG. 14, any eddy current is not generated in the end areas A1 of the conductive layer 231, and the eddy current flows through the central area A2 of the conductive layer 231. Therefore, since the heating roller 230 is not heated at 200° C. or more, a temperature difference of the heating roller 230 in the longitudinal direction can be inhibited from being enlarged.

Figure 15:
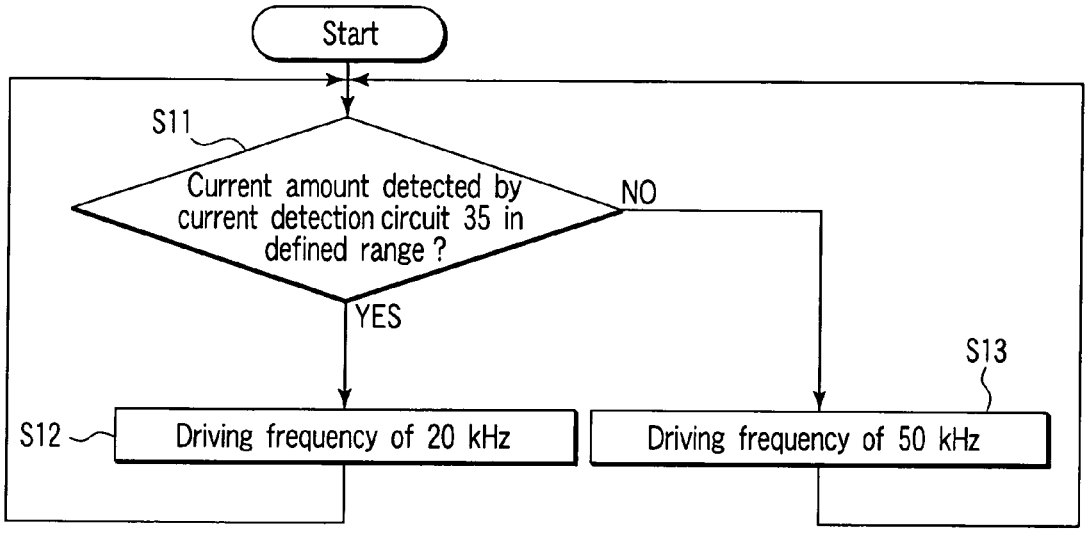
FIG. 15 is a flowchart showing one example of a heating apparatus control method applicable to the fixing device shown in FIG. 12.

Next, there will be described an induction heating control method based on the change of the electric resistance of the conductive layer 231 detected from the detected current supplied to the exciting coil 71 with reference to FIG. 15.

This method is applicable to the fixing device 140 described above with reference to FIGS. 12 to 14.

As described above, the CPU 24 drives the inverter circuit 29 at the predetermined driving frequency (20 kHz in the present embodiment), the high-frequency current generated by the inverter circuit 29 is supplied to the exciting coil 71, and the conductive layer 231 of the heating roller 230 is induction-heated. In a case where each end area A1 of the heating roller 230 exceeds the Curie temperature of 200° C., the electric resistance of each end area A1 of the heating roller 230 drops, the magnetic bonding between the conductive layer 231 and the exciting coil 71 weakens, and the load resistance of the exciting coil 71 is reduced. This increases the current flowing through the exciting coil 71.

The current supplied to the exciting coil 71 and detected by the current detection circuit 35 via the current transformer 34 is compared with the defined range of the value of the current flowing through the conductive layer 231 whose temperature does not reach the Curie temperature (S11). When the current detected by the current detection circuit 35 falls in the defined range (S11-YES), it is judged that the conductive layer 231 does not reach the Curie temperature. Moreover, the inverter circuit 29 is controlled at a driving frequency of 20 kHz as such (S12), and the high-frequency current corresponding to this driving frequency of 20 kHz is supplied to the exciting coil 71.

On the other hand, in a case where the current detected by the current detection circuit 35 exceeds the defined range in the step S11 (S11-NO), it is judged that the conductive layer 231 has exceeded the Curie temperature. Moreover, the inverter circuit 29 is controlled at a driving frequency of 50 kHz (S13), and a high-frequency current corresponding to this driving frequency of 50 kHz is supplied to the exciting coil 71.

Figure 16:
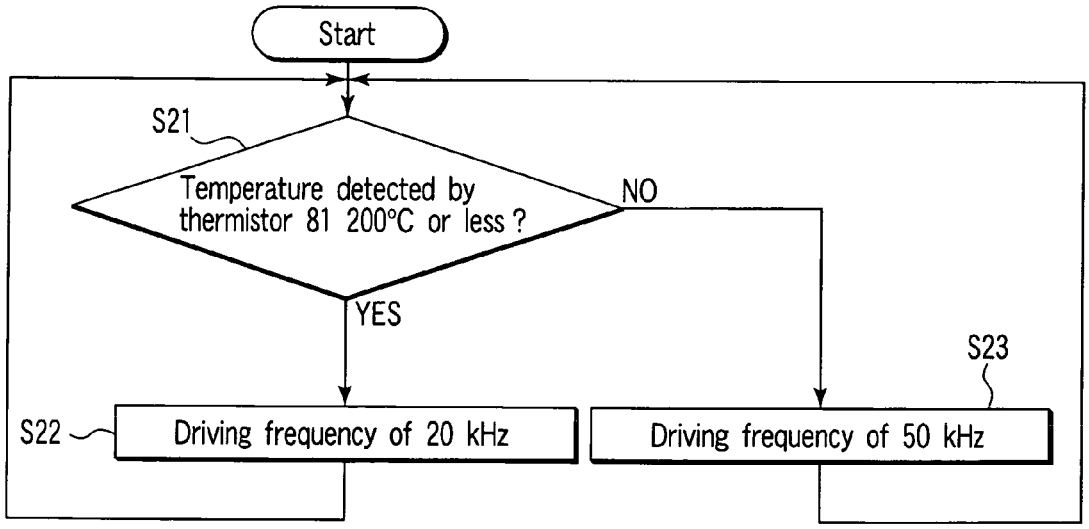
FIG. 16 is a flowchart showing another example of a heating apparatus control method applicable to the fixing device shown in FIG. 12.

Moreover, the control method in the fixing device 140 of the present embodiment is not limited to this example, and there may be performed, for example, an induction heating control method based on the change of the electric resistance of the conductive layer 231 detected using the temperature detecting section 8 which detects the temperature of the heating roller 230. There will be described the induction heating control method based on the change of the electric resistance of the conductive layer 231 detected from the temperature detected by the temperature detecting section 8 described above with reference to FIG. 16.

As described above, the CPU 24 drives the inverter circuit 29 at a driving frequency of, for example, 20 kHz, the high-frequency current is generated by the inverter circuit 29 and supplied to the exciting coil 71, and the conductive layer 231 of the heating roller 230 is thus induction-heated. The thermistor 81 detects the temperature of each end area A1 of the heating roller 230 induction-heated in this manner. Moreover, the temperature detected by the thermistor 81 is compared with the Curie temperature of the adjusted magnetism alloy for use in the conductive layer 231 at 200° C. (S21). In a case where the temperature detected by the thermistor 81 is not more than 200° C. (S21—YES), the inverter circuit 29 is controlled at the driving frequency of 20 kHz as such (S22), and the high-frequency current corresponding to this driving frequency of 20 kHz is supplied to the exciting coil 71.

On the other hand, in a case where the temperature detected by the thermistor 81 is above 200° C. in the step S21 (S21—NO), the inverter circuit 29 is controlled at a driving frequency of 50 kHz (S23), and the high-frequency current corresponding to this driving frequency of 50 kHz is supplied to the exciting coil 71.

As described above, in the induction heating control method of the present embodiment, (1) the driving frequency of the inverter circuit 29 is changed from 20 kHz to 50 kHz in a case where the current detected by the current detection circuit 35 exceeds the defined range. Moreover, (2) in a case where the temperature detected by the thermistor 81 exceeds the Curie temperature (200° C.), the thermistor being disposed in the end portion of the heating roller 230 in the longitudinal direction, the driving frequency of the inverter circuit 29 is changed from 20 kHz to 50 kHz.

As described above, when the temperature of the heating roller 231 is below the Curie temperature, the depth of penetration in the conductive layer 231 is small, and an apparent load resistance of the heating roller 230 is large. Therefore, as described above, the load resistance in a case where the only central area A2 of the heating roller 230 is heated is set to be substantially equal to that in a case where the whole sheet passing area including the end areas A1 and the central area A2 of the heating roller 230 is heated at the driving frequency of 20 kHz. Therefore, the only central area A2 of the heating roller 230 can be induction-heated without largely charging the current. In a case where the current detected by the current detection circuit 35 falls in the defined range, or the temperature detected by the thermistor 81 is not more than 200° C., the driving frequency of the inverter circuit 29 is 20 kHz. In consequence, the whole heating roller 230 can be heated.

Therefore, during continuous printing of, for example, a small-sized sheet, even in a case where the temperature rises in the only end portions of the heating roller 230 that do not pass this small-sized sheet, the end areas A1 of the heating roller 230 made of the adjusted magnetism alloy does not generate any heat at the Curie temperature, and the only central area A2 of the heating roller 230 can be heated. In consequence, the surface temperature of the heating roller 230 in the longitudinal direction can be uniform.

In the present embodiment, the conductive layer 231 of the heating roller 230 is formed into a thickness of 1 mm and a diameter of 40 mm. It has been described in the present embodiment that the driving frequency at which the whole heating roller 230 is induction-heated is 20 kHz, but the present invention is not limited to this embodiment, and the driving frequency may be changed in accordance with a material, positional relation, and the like of the exciting coil 71 or the conductive layer 230. It is to be noted that the driving frequency to induction-heat the whole heating roller 230 is in a range of preferably 20 to 40 kHz, more preferably 20 to 30 kHz. The driving frequency to induction-heat the only central area A2 of the heating roller 230 is in a range of preferably 40 kHz to 60 kHz.

The present invention is not limited to the above embodiments as such, and constituting elements can be modified and embodied in an implementation stage without departing from the scope. An appropriate combination of a plurality of constituting elements disclosed in the above embodiments can form various inventions. For example, several constituting elements may be removed from all of the constituting elements described in the embodiments. Furthermore, the constituting elements of different embodiments may be appropriately combined.

Figure 17:
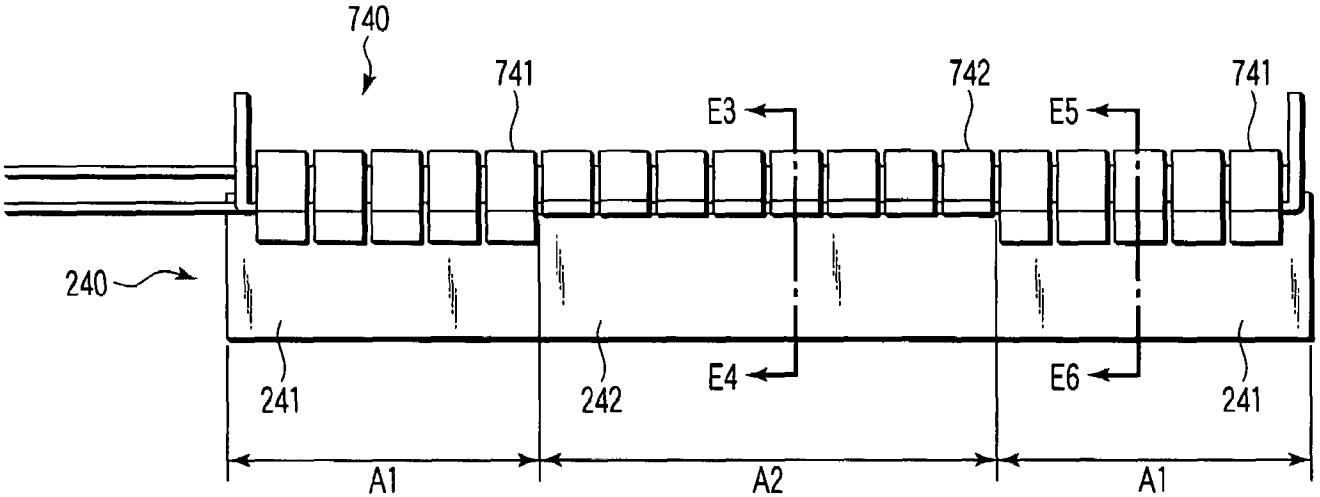
FIG. 17 is a schematic diagram showing a heating roller and an induction heating unit which are applicable to the above-described fixing device.
Figure 19:
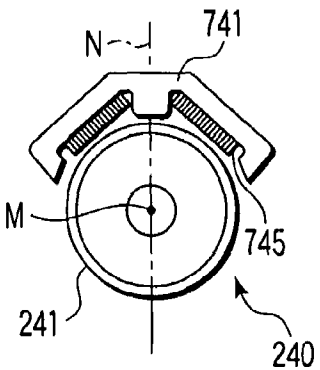
FIG. 19 is a sectional view cut along the arrows E5 and E6 shown in FIG. 17.
Figure 18:
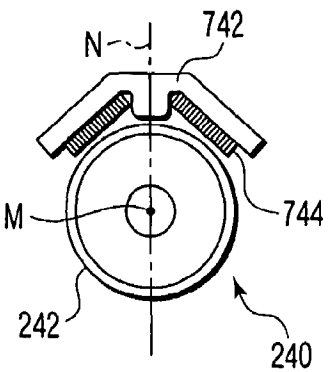
FIG. 18 is a sectional view cut along the arrows E3 and E4 shown in FIG. 17.

For example, as described in the above embodiments, iron has a high magnetic permeability and generates a large amount of heat as compared with aluminum. Therefore, as shown in FIGS. 17 to 19, a magnetic core 741 facing a conductive layer 241 made of aluminum may have a configuration which is different from that of a magnetic core 742 facing a conductive layer 242 made of iron. It is to be noted that FIG. 17 shows a schematic diagram of a heating roller and an induction heating unit which are applicable to the present invention. FIG. 18 shows a sectional view cut along the arrows E3 and E4 shown in FIG. 17. FIG. 19 is a sectional view cut along the arrows E5 and E6 shown in FIG. 17.

This example will be described in more detail. As shown in FIG. 17, a heating roller 240 includes the conductive layers 241 corresponding to end areas A1 and made of aluminum, and the conductive layer 242 corresponding to a central area A2 and made of iron. An induction heating unit 740 includes the magnetic cores 741 disposed in the end areas A1, and the magnetic cores 742 disposed in the central area A2.

As shown in FIG. 18, the magnetic core 742 holds an exciting coil 744, and this exciting coil 744 has a spiral shape around the axial center which is a virtual line N intersecting with an axis M of the heating roller 240. This magnetic core 742 is disposed on a side opposite to that on which the exciting coil 744 faces the conductive layer 242, and in the center of the exciting coil 744. On the other hand, as shown in FIG. 19, the magnetic core 741 holds an exciting coil 745, and this exciting coil 745 also has a spiral shape around the axial center which is a virtual line N in the same manner as in the exciting coil 744. The magnetic core 741 is disposed on a side opposite to that on which the exciting coil 745 faces the conductive layer 241, in the center of the exciting coil 745, and externally along the exciting coil. That is, the magnetic core 741 is formed into a shape to surround the exciting coil 745, and disposed closer to the heating roller 240.

As described above, the magnetic cores 741 have many portions disposed close to the exciting coil 745 and the heating roller 240 as compared with the magnetic cores 742, and a magnetic flux from the exciting coil 745 can be concentrated more intensely. Therefore, it is possible to increase an amount of heat to be generated by the conductive layer 241 of each end area A1 opposed to the magnetic cores 741, that is, the conductive layer 241 made of aluminum having a smaller amount of heat to be generated as compared with iron. Therefore, it is possible to reduce a difference of the amount of heat to be generated between the conductive layer 241 made of aluminum and the conductive layer 242 made of iron.

Moreover, there is not any restriction on the IGBTs 27 and 28 shown in FIG. 3 as long as they are switching elements, and in the present embodiments, they are preferably switching elements for use under large pressure and current, such as the IGBTs or MOS-FET.

Furthermore, in the present embodiments, any conductive material that satisfies the above-described conditions is applicable to the conductive layer, and there is used, for example, a stainless steel alloy, copper, a composite material of stainless steel and aluminum or the like.

In addition, there has been described an example of a half bridge circuit as the induction heating control circuit shown in FIG. 3, but the present invention is not limited to this example, and there is not any restriction on the circuit as long as the circuit can change its frequency. There may be used, for example, a semi-E-class inverter circuit (one switching element) for general use.

Moreover, the end areas A1 have been referred to also as the end portions because they are disposed in the opposite ends of the central area A2 in the above embodiments, but the present invention is not limited to this constitution, and the end area A1 may be disposed on only one side of the central area A2.

Furthermore, in the above embodiments, a generated heat distribution is divided by two types of metals, but the distribution may include three or more different types of metals in a constitution whose frequency can be changed among three or more types of frequencies.

What is claimed is:

1. A heating apparatus comprising:

a heating member including a conductive layer having a first conductive member positioned in a first area and a second conductive member positioned in a second area which is at least partially different from the first area; and an induction heating unit including one coil and a control unit which controls a frequency of a high-frequency current to be supplied to the coil, the induction heating unit induction-heating the conductive layer by a magnetic field generated from the coil, wherein the first conductive member has a property of a skin resistance $Rs \geqq 4.7\times10^{-5}$ (Ω), and the second conductive member has a property of a skin resistance $Rs \geqq 88\times10^{-5}$ (Ω) in a skin resistance of $$Rs = \frac{\rho}{\delta} = \sqrt{4\times\pi^2\times10^{-7}}\times\sqrt{f\cdot\mu\cdot\rho},$$

wherein ρ (Ω·m) denotes a resistivity of the conductive member,

μ denotes a relative permeability of the conductive member, and f (Hz) denotes the frequency of the high-frequency current flowing through the coil at a time when the frequency f of the high-frequency current which flows through the coil is in a range of 20 kHz to 30 kHz.

2. The heating apparatus according to claim 1, further comprising:

an induction heating circuit which selectively supplies a plurality of frequency currents to the coil.

3. The heating apparatus according to claim 1, wherein the induction heating unit induction-heats the only first conductive member in a first frequency region, and the induction heating unit induction-heats both of the first conductive member and the second conductive member in a second frequency region which is higher than the first frequency region.

4. The heating apparatus according to claim 3, wherein the first frequency region is below 40 kHz, and the second frequency region is 40 kHz or more.

5. The heating apparatus according to claim 3, further comprising:

a temperature detecting section including a first temperature detecting element which detects a temperature of the first area of the heating member, and a second temperature detecting element which detects a temperature of the second area of the heating member, wherein the control unit changes the frequency of the high-frequency current to be supplied to the coil based on a first temperature detected by the first temperature detecting element, and a second temperature detected by the second temperature detecting element.

6. The heating apparatus according to claim 5, wherein the control unit supplies the high-frequency current of the first frequency region to the coil, and induction-heats the only first conductive member, in a case where a difference between the first temperature and the second temperature exceeds a predetermined defined range.

7. The heating apparatus according to claim 1, wherein the conductive layer has a thickness of 20 μm or more.

8. The heating apparatus according to claim 1, wherein the second area of the conductive layer is an area through which a small-sized sheet passes, and the first area is adjacent to the second area in a direction crossing a sheet passing direction of the sheet at right angles, and does not pass the small-sized sheet therethrough.

9. The heating apparatus according to claim 1, wherein the first conductive member is made of aluminum, and the second conductive member is made of iron.

10. The heating apparatus according to claim 1, wherein the first conductive member is made of nonmagnetic stainless steel, and the second conductive member is made of nickel.

11. The heating apparatus according to claim 1, wherein the heating member has a roller structure.

12. The heating apparatus according to claim 1, wherein the heating member has a belt structure.

13. The heating apparatus according to claim 1, wherein the conductive layer has a laminated structure constituted of the first conductive member and the second conductive member in the second area, and the second conductive member is disposed on a side close to the coil.

14. The heating apparatus according to claim 1, wherein the conductive layer is formed of the same conductive material in a thickness direction, and includes the first conductive member positioned in the first area and the second conductive member positioned in the second area.

15. A heating apparatus comprising:

a heating member including a conductive layer which loses magnetism at a temperature above a predetermined temperature;

a heating unit which includes one coil and which heats the conductive layer by induction heating; and a control unit which controls a frequency of a high-frequency current to be supplied to the coil in accordance with a change of a load resistance of the coil.

16. The heating apparatus according to claim 15, further comprising:

a current detection unit which detects an amount of current to be supplied to the coil, wherein the control unit detects a change of a load resistance of the coil based on the amount of current detected by the current detection unit.

17. The heating apparatus according to claim 15, further comprising:

a temperature detecting section which detects temperature information of the heating member, wherein the control unit detects a change of a load resistance of the coil based on the temperature information detected by the temperature detecting section.

18. The heating apparatus according to claim 17, wherein the temperature detecting section includes at least a first temperature detecting element which detects a temperature of a first area of the heating member, and a second temperature detecting element which detects a temperature of a second area of the heating member.

19. The heating apparatus according to claim 17, wherein the second area of the conductive layer is an area through which a small-sized sheet passes, and the first area is adjacent to the second area in a direction crossing a sheet passing direction of the sheet at right angles, and does not pass the small-sized sheet therethrough.

20. An induction heating control method comprising:

induction-heating, by an induction heating unit including one coil, a heating member including a conductive layer having at least a first conductive member positioned in a first area and a second conductive member positioned in a second area which is different from the first area;

comparing, with a predetermined first defined temperature, a second temperature detected by a second temperature detecting element which detects a temperature of the second area;

comparing a first temperature detected by a first temperature detecting element which detects a temperature of the first area with a second defined temperature which is higher than the first defined temperature in a case where the second temperature is not more than the first defined temperature;

supplying, to the coil, a high-frequency current of a first frequency region which induction-heats the only first conductive member in a case where the first temperature is not less than the second defined temperature; and supplying, to the coil, a high-frequency current of a second frequency region which induction-heats both of the first conductive member and the second conductive member in a case where the first temperature is less than the second defined temperature.

* * * * *